US005083104A

United States Patent [19]

Bassino

[11] Patent Number: 5,083,104

[45] Date of Patent: Jan. 21, 1992

[54] MINIATURE RELAY

[75] Inventor: Walter Bassino, Sao Paulo, Brazil

[73] Assignee: Schrack Electronica LTDA., Itapecerica Da Serra, Brazil

[21] Appl. No.: 526,437

[22] Filed: May 21, 1990

[30] Foreign Application Priority Data

Apr. 4, 1990 [BR] Brazil ..... PI9001560

[51] Int. Cl.[5] ..... H01H 67/02

[52] U.S. Cl. ..... 335/128; 335/78

[58] Field of Search ..... 335/78-85, 335/121, 124, 128, 202

[56] References Cited

U.S. PATENT DOCUMENTS 4,745,382 5/1988 Dittmann ..... 335/128
4,827,232 5/1989 Minks ..... 335/78
4,924,197 5/1990 Siepmann ..... 335/128

*Primary Examiner*—Gerald P. Tolin
*Assistant Examiner*—Lincoln Donovan
*Attorney, Agent, or Firm*—Oliff & Berridge

[57] ABSTRACT

A miniature relay comprises a main body (1) having a coil (2) disposed on a core (3) riveted to a yoke (4), the yoke having a segment (4″) substantially parallel to the axis of the coil (2) and receiving an armature (5) withheld by a resilient member (6), which maintains the armature transversely positioned relative to the core (3) and able to be attracted at least by a magnetic field produced by the coil (2), with the armature(5) being further provided with a flexible blade (7) on which two extreme breaker points (8) are held, the assembly being also provided with a supporting base (9), where fixed breaker points (10) are received and in which the extreme breaker points of the blade (7) operate, and a box (11) attachable to the said base (9), with the blade (7) being formed by a bifurcated plate, bordering a portion (12) for interconnection to the armature body and two elongated coplanar branches (13), whose free ends receive the breaker points (8) and, adjoining the point of bifurcation, are provided with a bend (14) whereby the entire extreme portion of branches (13) is held away from the armature body (5); while the fixed breaker points (10) are each mounted on a resilient structure (17), housed by a compartment (18) provided in a subassembly (19), fixed to a blade holder (20). Among other advantages, the relay provides a low noise level.

7 Claims, 1 Drawing Sheet

MINIATURE RELAY

BACKGROUND OF THE INVENTION

As is presently known to those skilled in the art, miniature electromagnetic relays are basically comprised by a coil, integral with a fixed yoke, and by a movable armature member that opens and closes an electric circuit with the electromagnetic effect produced by the flow of an electric current through said coil. Accordingly, the armature member is provided with one or more flexible breaker-point blades, which move between two or more fixed breaker points, enabling switching and/or reversion of electric-current flow, the intensity of which being higher or lower, according to each relay's particular specifications.

The heretofore widely used miniature relays thus display certain deficiencies, that is, during the opening and closing operation, a dead impact always occurs, of the armature member on the yoke and/or of the breaker points, producing audible frequencies of greater or lesser intensity, according to each individual relay.

SUMMARY OF THE INVENTION

In view of this deficiency and to overcome it completely, making relay operation soundless and regular, the improved miniature relay of the present invention has been developed, whose movable blades are provided with a special design to enable minimum pressures to be achieved between the breaker points, which pressures are dependent upon the metallographic characteristics of the blades and fixed breaker-point holders, and also upon the curves followed by the blades; the fixed breaker-point blade holder assembly is likewise provided with a special design and suitable bends, to reduce two-way impact between the breaker points, thus providing less noise in relay operation and increasing the device's service life.

In addition, the subject miniature relay is provided with a fully modular design so that, whenever deviations occur in the prescribed values (specifications), it is easy to recover the assembly by simply replacing the faulty component, without sacrifice of the remaining parts.

BRIEF DESCRIPTION OF THE DRAWINGS

The attached drawings illustrate the improved relay, object of the present invention, wherein.

DETAILED DESCRIPTION OF THE PREFERRED EMBODIMENTS

Figure 1:
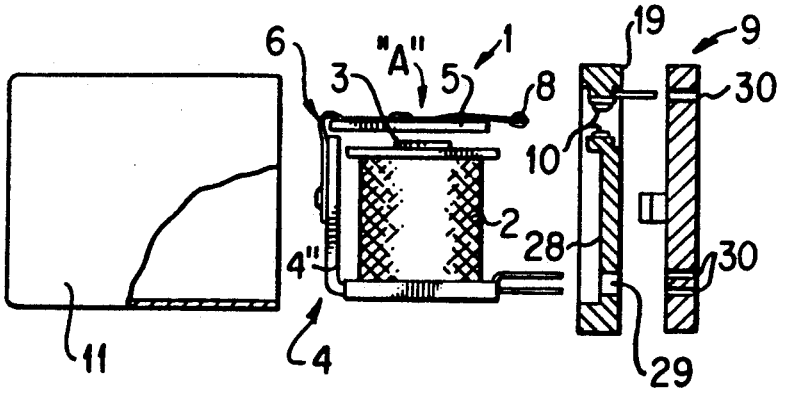
FIG. 1 illustrates a side view thereof, with parts considered separately, a view "A" being indicated.

According to the illustrations contained in the figures listed above, the subject improved miniature relay is of the type comprised by a main body 1 having a coil 2 disposed on a core 3 riveted to a yoke 4, the yoke having a segment 4'' substantially parallel to the axis of the coil 2 and receiving an armature 5 held by resilient means 6, which maintains the said armature transversely positioned relative to the core 3 and able to be attracted thereto by a magnetic field produced by the coil 2, with the armature 5 being further provided with a flexible blade 7 on which two extreme breaker points 8 are held. The assembly is further provided with a supporting base 9, where fixed breaker points 10 are received and on which the extreme breaker points of the blade 7 operate, and a box 11 attachable to the said base 9.

Figure 2:
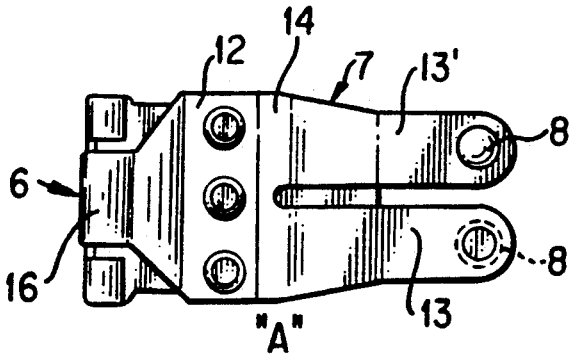
FIG. 2 illustrates a view according to "A" indicated in FIG. 1.

In turn, the improvements introduced consist, firstly, in the blade 7 being formed by a bifurcated plate, bordering a portion 12 for interconnection to the armature body and two elongated coplanar branches 13, whose free ends receive the breaker points 8 and, adjoining the point of bifurcation, are provided with a bend 14 whereby the entire extreme portion of branches 13 is held away from the armature body 5, the latter being further provided with an extreme top 15 that extends transversely relative to branches 13, establishing points to support them intermediately when flexed toward the armature 5 (FIG. 2).

In turn, from blade 7, there extends a narrower segment 16, oppositely positioned relative to branches 13, being provided with a section bent normal to armature 5 and with the extremity thereof affixed laterally to yoke 4, thereby forming the resilient means 6.

In addition, on one of the branches 13' of the blade 7 which one normally closed, the bend 14 thereof acts with an opposing pressure, in grams, greater than the assembly's magnetic force, to ensure (sic.), in the event of breaker-point sticking, a short circuit between the two branches 13.

Figure 3:
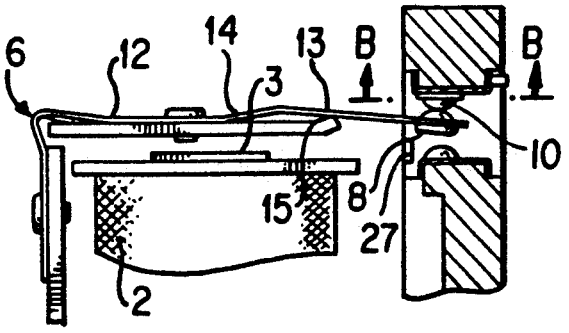
FIG. 3 illustrates an enlarged detail of the anchor portion and of the breaker points, with section B—B being indicated.
Figure 4:
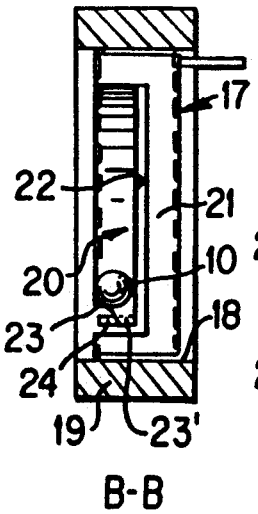
FIG. 4 illustrates a view along section B—B, showing a plan view of the fixed breaker points.
Figure 5:
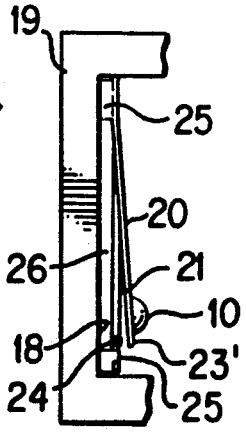
FIG. 5 illustrates a profile view of one of the fixed breaker points.
Figure 6:
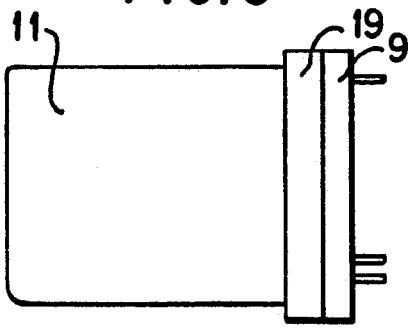
FIG. 6 illustrates an outside view of the assembled relay.

On the other hand, each of the fixed breaker points 10 is also mounted on a resilient structure 17, housed by an elongated compartment 18 provided in a subassembly 19, fixed to blade holder 20, with the resilient structure 17 being formed by an elongated plate 21, wherein an L-shaped cutout 22 is provided to limit an area with free sides and with a cantilevered one end 23, having extreme appendixes 23' movable between corresponding travel limiters 24, to further enhance the assembly's safety against short circuits, thereby forming the blade holder 20 that receives one of the breaker-point means 10, while the longitudinal edges of the said plate 21 are bent inward to comprise jaws 25 for securing at corresponding steps 26 disposed along the side walls of the compartment 18 (FIGS. 3, 4 and 5).

In subassembly 19, parallel to the fixed blade 17 and beside that branch 13', a limiting projection 27 is provided to prevent short circuits between the opposite breaker-point head and the lower, normally open fixed blade while the relay is energized.

It should be noted that this design provided for the miniature relay causes its system to become fully elastic and with damping action on all moving parts, thereby enabling generation of audible frequencies to be substantially reduced and also providing, as added advantages, lower transfer of metal between breaker points, a more extended service life for the product, lower loss in the amount of components and a fuller guarantee of the product for the consumer.

Finally, in this design of a completely modular device, the subassembly 19, on which the blades on blade holder 20 are held, is made up by a short body provided with an internal recess 28 in which the main body 1 is supported and that has one or more openings 29 through which the electric terminals of the coil 2 may pass, said subassembly 19 being further arranged, in a disposable manner, between body 1 and the supporting base 9, the latter being provided with passageways 30 for the terminals of the coil 2 and of the fixed breaker points 10 (FIG. 1).

It should be explained that the blades on blade holder 20 are considered fixed because they are not subject to the action of the coil 2; however, since one of their ends is cantilevered (FIGS. 4 and 5), the breaker points 10 located thereon are allowed to move slightly, as a result of the assembly's elasticity, made possible by the resilient structure 17 and by the subassembly 19, which is fabricated with plastic material whose constructive characteristics set the degree of elasticity of the blades fixed to blade holder 20, to predetermine the pressure gradients at the beginning and end of travel upon make-and-break operation of the relay.

What is claimed is:

1. A miniature relay assembly comprising a main body (1) having a coil (2) disposed on a core (3) riveted to a yoke (4), the yoke having a segment (4'') substantially parallel to an axis of the coil (2), the yoke receiving an armature (5) withheld by resilient means (6), said resilient means maintaining the said armature transversely positioned relative to the core (3) and able to be attracted to the core by a magnetic field produced by the coil (2), the armature (5) being further provided with a flexible blade (7) on which two extreme breaker points (8) are held, the assembly being also provided with a supporting base (9) which receives fixed breaker points (10) and in which the extreme breaker points (8) of the blade (7) operate, and a box (11) attachable to the said base (9), characterized in that the blade (7) is formed by a bifurcated plate, said bifurcated plate having a portion (12) for interconnection to the armature and two elongated coplanar branches (13), having free ends which receive the extreme breaker points (8) and, a bend (14) adjoining the point of bifurcation of the bifurcated plate, whereby entire extreme portions of said branches (13) are held away from the armature (5), the armature being further provided with an extreme top (15) that extends transversely relative to said branches (13), establishing points to support said branches intermediately when flexed toward the armature, the fixed breaker points (10) each being mounted on a resilient structure (17), housed by a compartment (18) provided in a subassembly (19), fixed to a blade holder (20).

2. The miniature relay assembly according to claim 1, wherein one of said branches is normally closed, and in the normally closed (13') branch of the blade (7), the bend (14) thereof acts with an opposing pressure greater than the magnetic force of the assembly.

3. The miniature relay assembly according to claim 1, characterized in that the resilient structure (17) is formed by an elongated plate (21), wherein an L-shaped cutout (22) is provided to limit an area with free sides, said cutout having a cantilevered one end (23), having an extreme appendix (23') movable between corresponding travel limiters (24), thereby forming the blade holder (20) that receives one of the fixed breaker points (10) said plate (21) having longitudinal edges which are bent inward to comprise jaws (25) for securing blade holder 20 at corresponding steps (26) disposed along side walls of the compartment (18).

4. The miniature relay assembly according to claim 1, wherein a limiting projection (27) is provided parallel to the blade holder 20 and beside a normally closed branch (13') of said branches (13).

5. The miniature relay assembly according to claim 1, characterized in that a portion (12) of the blade (7) is provided with a narrower segment (16), oppositely positioned relative to branches (13), having a section bent normal to said armature, an extremity of the normal bent section being affixed laterally to the yoke (4).

6. The miniature relay assembly according to claim 1 characterized in that the subassembly (19), on which the blade holder (20) is held, comprises a short body provided with an internal recess (28) on which the main body (1) is supported, the recess having one or more openings (29) through which electric terminals of the coil (2) pass, said subassembly (19) being further arranged, in a disposable manner, between the main body (1) and the supporting base (9), the supporting base being provided with passageways (30) for the electric terminals of the coil (2) and electric terminals of the fixed breaker points (10).

7. The miniature relay assembly according to claim 2, characterized in that the subassembly (19), on which the blade holder (20) is held, comprises a short body provided with an internal recess (28) on which the main body (1) is supported, the recess having one or more openings (29) through which electric terminals of the coil (2) pass, said subassembly (19) being further arranged, in a disposable manner, between the main body (1) and the supporting base (9), the latter supporting base being provided with passageways (30) for the electric terminals of the coil (2) and electric terminals of the fixed breaker points (10).

* * * * *